US011117398B2

(12) United States Patent
Lee et al.

(10) Patent No.: US 11,117,398 B2
(45) Date of Patent: Sep. 14, 2021

(54) PHOTO PRINTER

(71) Applicant: DS GLOBAL, Seoul (KR)

(72) Inventors: Yong Duk Lee, Gunpo-si (KR); Hee Pil Yoon, Seoul (KR)

(73) Assignee: DS GLOBAL, Seoul (KR)

( * ) Notice: Subject to any disclaimer, the term of this patent is extended or adjusted under 35 U.S.C. 154(b) by 0 days.

(21) Appl. No.: 16/759,034

(22) PCT Filed: Oct. 24, 2018

(86) PCT No.: PCT/KR2018/012648

§ 371 (c)(1),
(2) Date: Apr. 24, 2020

(87) PCT Pub. No.: WO2019/088556

PCT Pub. Date: May 9, 2019

(65) Prior Publication Data

US 2020/0276837 A1 Sep. 3, 2020

(30) Foreign Application Priority Data

Oct. 31, 2017 (KR) ..... 10-2017-0143962
Nov. 17, 2017 (KR) ..... 10-2017-0153771
(Continued)

(51) Int. Cl.
*B41J 11/14* (2006.01)
*B41J 11/04* (2006.01)

(52) U.S. Cl.
CPC ..... *B41J 11/04* (2013.01); *B41J 11/14* (2013.01)

(58) Field of Classification Search
CPC ..... B41J 11/04; B41J 3/445; B41J 2/32; B41J 23/02; B41J 25/34; B41J 11/14
See application file for complete search history.

(56) References Cited

U.S. PATENT DOCUMENTS 5,576,741 A * 11/1996 Johnson ..... B41J 13/10 346/145
6,936,768 B2 * 8/2005 Sakiyama ..... B41J 29/02 174/520
2005/0141948 A1 6/2005 Sawai

FOREIGN PATENT DOCUMENTS

JP 2002-331720 * 11/2002 ..... B41J 25/304
JP 3761417 3/2006
(Continued)

OTHER PUBLICATIONS

Machine translation of JP 2002-331720, published on Nov. 2002.*
(Continued)

*Primary Examiner* — Huan H Tran
(74) *Attorney, Agent, or Firm* — Cantor Colburn LLP

(57) ABSTRACT

Provided is a photo printer including: a paper supply unit for accommodating stacked sheets of paper and having a pickup roller protruding from a bottom surface thereof; a platen roller provided at a front end of the paper supply unit; a head provided above the platen roller so as to form an image on the paper fed; a motor for providing a driving force to the platen roller; deceleration gears for decreasing revolutions per minute of the motor; a gear plate provided at one side of the paper supply unit and having the deceleration gears shaft-coupled thereto; and a motor plate having an aligning hole adapted to pass the shaft of the deceleration gear therethrough and a motor hole adapted to pass a rotary shaft of the motor therethrough.

6 Claims, 16 Drawing Sheets

(30) Foreign Application Priority Data

Nov. 27, 2017 (KR) ..... 10-2017-0159127
Nov. 27, 2017 (KR) ..... 10-2017-0159131

(56) References Cited

FOREIGN PATENT DOCUMENTS

| | | |
|---|---|---|
| JP | 2007276491 | 10/2007 |
| KR | 20050040686 | 5/2005 |
| KR | 20170090865 | 8/2017 |

OTHER PUBLICATIONS

Machine translation of JP 3761417B, published on Mar. 2006.*
International Search Report—PCT/KR2018/012648 dated Jan. 30, 2019.

* cited by examiner (a)

(b)

(a)

(b)

PHOTO PRINTER

TECHNICAL FIELD

The present invention relates to a photo printer, and more particularly, to a photo printer that is capable of allowing a pinion, deceleration gears, and a platen gear to be coupled thereto, while distances among their shafts are being accurately maintained.

BACKGROUND ART

A camera mounted on a smart device like a smartphone has similar performance to a general digital camera, and many people have taken their pictures with their smart device carried always with them, not with a digital camera. Accordingly, a consumer's desire to take his or her picture and to instantly print the picture, without any separate conversion, has been gradually increased.

So as to satisfy such consumer's desire, photo printers have been proposed so that pictures on smartphones can be instantly printed whenever and wherever.

There are various kinds of photo printers, but among them, particularly, a photo printer is proposed wherein printing paper to which a zero-ink printing technology is adopted is used, thereby requiring no ink or cartridge to reduce the maintenance cost thereof. In case of such zero-ink printing technology, the part corresponding to the cartridge is contained in the paper, and accordingly, only heat is used to express colors. That is, dyes, which respond to heat and thus express colors, are laminated on the paper, so that the heating temperature or heating time of a head is controlled to print images (pictures) or texts.

FIGS. 1 to 3 shows a conventional photo printer 1. As shown, the photo printer 1 includes a paper supply unit 10, a frame 20, a pickup roller R1, a platen roller R2, a head 40, a swing bracket 50, and a pressurizing bracket 60.

The paper supply unit 10 has an accommodation space 11 formed thereon to stack up and down a plurality of paper cut to a generally rectangular shape thereon, and the pickup roller R1 protrudes from a bottom surface of the paper supply unit 10 to transfer the paper located at the lowermost position among the stacked paper one by one in a forward direction.

The frame 20 is shaft-coupled to both sides of the paper supply unit 10 in such a manner as to allow the platen roller R2 to be located at the front end of the paper supply unit 10. Further, gears for transferring a driving force to the platen roller R2 and the pickup roller R1 are coupled to the frame 20 by means of shafts.

The platen roller R2 is shaft-coupled to the front end of the frame 20.

The head 40 is disposed above the platen roller R2 and is adapted to apply given heat to the paper to express colors corresponding to the given heat, thereby printing images or texts. Further, the head 40 includes heat emitting elements 41, a PCB 42 adapted to control the heat emitting elements 41, and a heating sink 43 disposed above the heat emitting elements 41 to radiate heat generated from the heat emitting elements 41.

The paper enters a space between the head 40 and the platen roller R2, and the head 40 is rotatably mounted onto the swing bracket 50.

Furthermore, the head 40 comes into close contact with the paper to apply the heat to the paper, and so as to allow the head 40 to come into close contact with the paper, accordingly, the pressurizing bracket 60 is provided to pressurize the head 40 downward.

Further, springs S are connected between the pressurizing bracket 60 and locking portions 21 formed on the frame 20 to allow the head 40 to come into elastic contact with the platen roller R2.

Referring to FIGS. 4*a* to 5, a power transfer structure for transferring the paper to the platen roller R2 will be in detail explained.

As shown, a motor M is located on one side wall 20*a* of the frame 20, and a driving force of the motor M is transferred to a pinion p. Next, the driving force is reduced through a plurality of deceleration gears 30 and is then transferred to a platen gear pg. After that, the platen roller R2, which is shaft-coupled to the platen gear pg, is thus rotated.

Further, a rotary force of the platen roller R2 allows a pickup gear pug to be rotated through power transfer gears 70 located on the other side wall 20*b* of the frame 20 in such a manner as to engage with the platen gear pg, and as a result, the pickup roller R1 is rotated (See FIG. 4*a*).

The frame 20 has a motor hole formed on one side wall 20*a* thereof so as to allow the pinion p to be fitted to a rotary shaft mh of the motor M, a plurality of mounting holes formed thereon so as to fit shafts sh1 to sh3 of the deceleration gears 30 thereto, and a though hole formed thereon so as to allow the platen gear pg to be fitted to a shaft ph of the platen roller R2 (See FIG. 4*b*).

The deceleration gears 30 include a first deceleration gear 31 engaging with the pinion p, a second deceleration gear 32 engaging with a drive gear 31*a* located integrally with one side surface of the first deceleration gear 31, a third deceleration gear 33 engaging with a drive gear 32*a* located integrally with one side surface of the second deceleration gear 32, a fourth deceleration gear 34 engaging with a drive gear 33*a* located integrally with one side surface of the third deceleration gear 33, and a fifth deceleration gear 35 engaging with a drive gear 34*a* located integrally with one side surface of the fourth deceleration gear 34. A driving force, which is reduced by allowing a drive gear 35*a* located integrally with one side surface of the fifth deceleration gear 35 to engage with the platen gear pg, is thus transferred to the platen roller R2 (See FIG. 5).

Furthermore, the first deceleration gear 31 and the third deceleration gear 33 are adjacently fitted to the same shaft sh1 as each other, and the second deceleration gear 32 and the fourth deceleration gear 34 are adjacently fitted to the same shaft sh2 as each other.

If the motor hole, the mounting holes, and the through hole are machined on one side wall 20*a* of the frame 20 in consideration of a distance d1 between the rotary shaft mh of the motor M and the shaft sh1 of the first deceleration gear 31, a distance d2 between the shaft sh1 of the first deceleration gear 31 and the shaft sh2 of the second deceleration gear 32, a distance d3 between the shaft sh2 of the fourth deceleration gear 34 and the shaft sh3 of the fifth deceleration gear 35, and a distance d4 between the shaft sh3 of the fifth deceleration gear 35 and the shaft ph of the platen gear pg, accordingly, the distances among the shafts of the respective gears can be constantly maintained.

Next, the motor M and the pinion p are fitted to the machined motor hole, the shafts sh1 to sh3 of the deceleration gears 30 are fitted to the machined mounting holes, and the shaft ph of the platen roller R2 is penetratedly coupled to the machined through hole. As a result, the distances among the shafts, as designed, can be constantly maintained.

In detail, the motor M, the pinion p, and the deceleration gears 31 to 35 are mounted on one side wall 20*a* of the frame 20 and the platen roller R2 is penetratedly coupled to one side wall 20*a* of the frame 20, so that the distances among the shafts of the respective gears can be accurately maintained, thereby allowing the respective gears to precisely engage with one another.

As the motor M, the pinion p, and the deceleration gears 31 to 35 are mounted on one side wall 20*a* of the frame 20 and the platen roller R2 is penetratedly coupled to one side wall 20*a* of the frame 20, however, there is a limitation in designing the photo printer to various shapes. For example, there is a restriction in re-arranging the motor and the deceleration gears so as to drastically reduce a size of an engine in the photo printer.

As the first deceleration gear 31 and the third deceleration gear 33 are adjacently fitted to one shaft sh1 and the second deceleration gear 32 and the fourth deceleration gear 34 are adjacently fitted to one shaft sh2, further, the gears adjacent to each other may have bad influences on each other.

For example, the rotary force of the first deceleration gear 31 has to be transferred to the second deceleration gear 32, but undesirably, it may be also transferred to the third deceleration gear 33 adjacent to the first deceleration gear 31. In this case, a deceleration rate may be changed to cause the transfer speed of the paper to be different from a set speed, thereby making a quality of printing deteriorated badly.

The deceleration gears 31 to 35 for transferring the driving force to the platen roller R2 are located on one side wall 20*a* of the frame 20, and the power transfer gears 70 for transferring the driving force to the pickup roller R1 are on the other side wall 20*b* of the frame 20. As the gears are located on both side walls of the frame 20, in detail, the size of the photo printer becomes bulky, and as the number of gears is great, accurate engagement may be not achieved, thereby making it difficult to control a speed ratio between the pickup roller R1 and the platen roller R2.

Referring to FIG. 6, further, hinge pins 22 protrude integrally from both sides of the paper supply unit 10.

Further, the swing bracket 50 and the pressurizing bracket 60 have hinge holes 51 and 61 formed on both ends of the other end thereof in such a manner as to be hinge-coupled to the hinge pins 22.

Now, an explanation on a process of rotatably coupling the swing bracket 50 and the pressurizing bracket 60 to top of the paper supply unit 10 will be given.

First, any one side hinge hole 51 of the swing bracket 50 on which the head 40 is mounted is coupled to one hinge pin 22. Next, the other side hinge hole 51 is coupled to the other hinge pin 22. So as to couple the other side hinge hole 51 to the other hinge pin 22, at this time, a force is applied to the other end of the swing bracket 50, so that the swing bracket 50 becomes open. Accordingly, the swing bracket 50 is made of a metal material that is capable of allowing a distance between both side hinge holes 51 to be open and being returned to its original shape after the hinge pins 22 have been fitted to the hinge holes 51.

In the coupling process, the swing bracket 50 can be returned to its original shape after the distance between both side hinge holes 51 has been open, but according to characteristics of the metal material, it cannot be perfectly returned to its original shape. After the swing bracket 50 is hinge-coupled to the paper supply unit 10, in detail, the distance between both side hinge holes 51 may be somewhat larger than a given distance set in a process of manufacturing the photo printer. Accordingly, the head 40 may be not placed accurately in position.

In the same manner as the swing bracket 50, also, the pressurizing bracket 60 is hinge-coupled to the paper supply unit 10, thereby causing the above-mentioned problems the swing bracket 60 has had.

DISCLOSURE

Technical Problems

Accordingly, the present invention has been made in view of the above-mentioned problems occurring in the related art, and it is an object of the present invention to provide a photo printer that is capable of allowing a pinion, deceleration gears, and a platen gear to be coupled thereto, while distances among their shafts are being accurately maintained.

It is another object of the present invention to provide a photo printer that is capable of avoiding the interference between deceleration gears adjacently coupled to one shaft.

It is yet another object of the present invention to provide a photo printer that is capable of easily mounting a swing bracket to which a head is fixed onto a paper supply unit, without any deformation.

It is still another object of the present invention to provide a photo printer that is capable of drastically reducing the number of gears for transferring a driving force of a motor.

Technical Solutions

To accomplish the above-mentioned objects, according to one aspect of the present invention, there is provided a photo printer including: a paper supply unit for stackedly accommodating paper and having a pickup roller protruding from a bottom surface thereof; a platen roller provided at a front end of the paper supply unit; a head provided above the platen roller to form an image on the paper fed; a motor for providing a driving force to the platen roller; deceleration gears for reducing revolutions per minute of the motor; a gear plate provided on one side surface of the paper supply unit in such a manner as to allow the deceleration gears to be shaft-coupled thereto; and a motor plate having an aligning hole adapted to allow one of the deceleration gears to pass therethrough and a motor hole adapted to allow a rotary shaft of the motor to pass therethrough.

According to the present invention, desirably, so as to allow the motor plate to be coupled to one side surface of the paper supply unit, the motor plate has a through hole formed thereon and the paper supply unit has a coupling hole formed thereon, the through hole being larger than the coupling hole.

According to the present invention, desirably, the gear plate to which the deceleration gears are shaft-coupled has the aligning hole formed thereon to pass the shaft of the deceleration gear most closely adjacent to the motor therethrough.

According to the present invention, desirably, the two or more deceleration gears are adjacently fitted to one shaft mounted on the gear plate, and a separation plate is provided between the deceleration gears adjacently fitted to one shaft.

According to the present invention, desirably, the photo printer further includes: a swing bracket having one end on which the head is mounted and the other end having hinge holes coupled to both sides of the paper supply unit; and hinge pins coupled to the side walls of the paper supply unit in such a manner as to pass through the hinge holes of the swing bracket.

According to the present invention, desirably, each hinge pin includes: a spiral portion formed on an outer peripheral surface thereof in such a manner as to be screw-coupled to the side wall of the paper supply unit; and a non-spiral portion protruding from the side wall of the paper supply unit in such a manner as to become a center of rotation of the swing bracket.

To accomplish the above-mentioned objects, according to another aspect of the present invention, there is provided a photo printer including: a paper supply unit for stackedly accommodating paper and having a pickup roller protruding from a bottom surface thereof; a platen roller provided at a front end of the paper supply unit; a head provided above the platen roller to form an image on the paper fed; a geared motor having a deceleration part built therein to reduce revolutions per minute produced therefrom; a pinion to which the reduced driving force of the geared motor is transferred; a platen gear coupled to a shaft of the platen roller in such a manner as to engage with the pinion; and a pickup gear coupled to a shaft of the pickup roller in such a manner as to engage with the pinion.

According to the present invention, desirably, the photo printer further includes: a first transfer gear disposed between the pinion and the platen gear; and a second transfer gear disposed between the pinion and the pickup gear.

Advantageous Effects

According to the present invention, the photo printer is capable of allowing the pinion and the deceleration gears to be coupled thereto even if the pinion is not mounted onto the gear plate, while distances between their shafts are being accurately maintained. Accordingly, the photo printer can accurately move the paper, thereby obtaining high quality images.

According to the present invention, further, the photo printer is capable of avoiding the interference between the deceleration gears adjacently coupled to one shaft to allow the driving force of the motor to be constantly reduced, thereby improving a degree of accuracy in transferring the paper.

According to the present invention, furthermore, the photo printer is capable of rotatably mounting the swing bracket to which the head is fixed onto the paper supply unit, without any deformation, thereby allowing the head to be fixed in a perpendicular direction to the transfer direction of the paper and constantly forming the given gap between the head and the platen roller.

According to the present invention, in addition, further, the photo printer is capable of drastically reducing the number of gears constituting a driving system, thereby being reduced in size, slimmed in design, and decreased in manufacturing cost.

BEST MODE FOR INVENTION

Hereinafter, an explanation on a configuration and an operation of a photo printer according to a first embodiment of the present invention will be in detail given with reference to the attached drawings.

Figure 7:
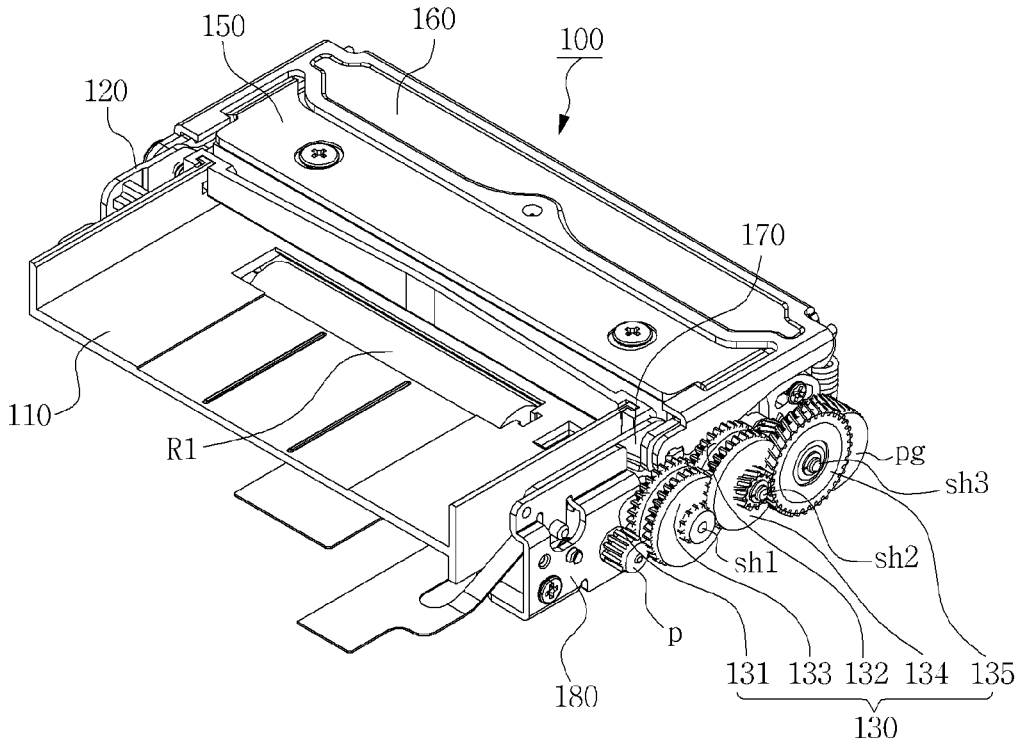
FIGS. 7 to 10 show a photo printer according to a first embodiment of the present invention.
Figure 8:
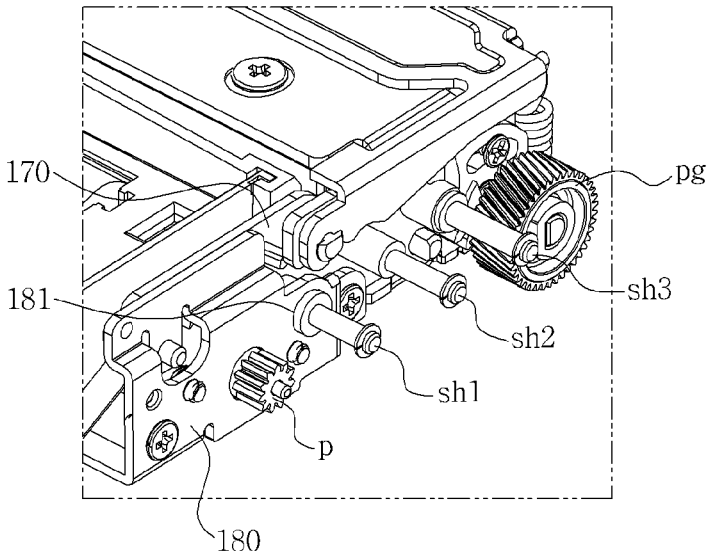
Figure 9:
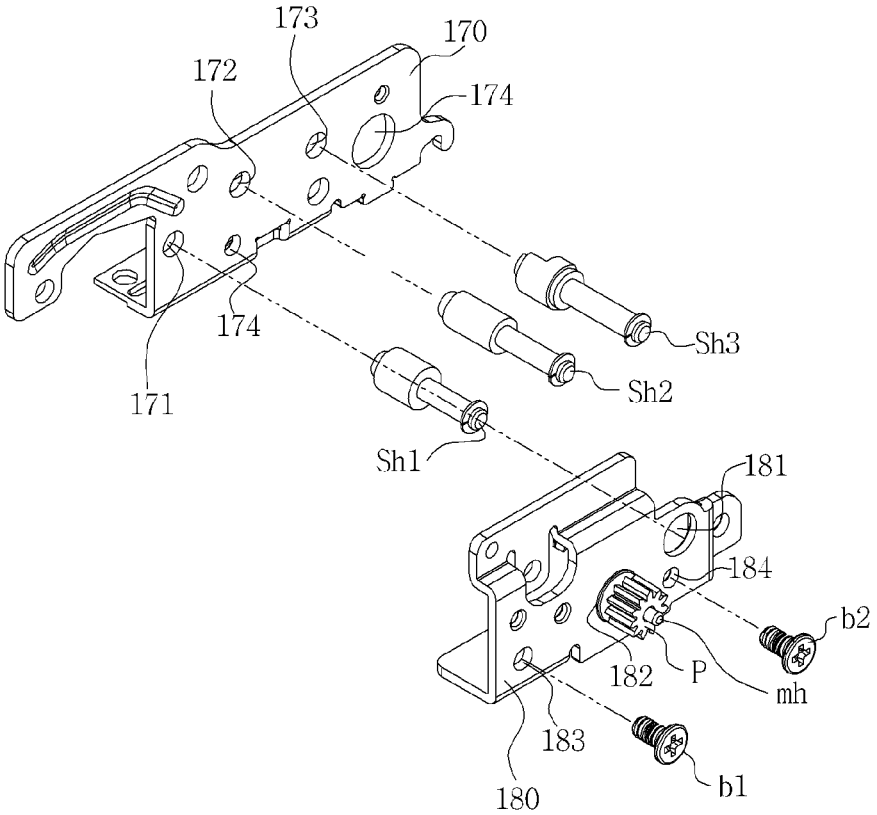

As shown in FIGS. 7 to 9, a photo printer 100 according to a first embodiment of the present invention includes a paper supply unit 110 for stackedly accommodating paper and having a pickup roller R1 protruding from a bottom surface thereof, a platen roller R2 provided at a front end of the paper supply unit 110, a head provided above the platen roller R2, a swing bracket 150 adapted to allow the head to be rotatably mounted onto the paper supply unit 110, and a pressurizing bracket 160 rotatably mounted onto the paper supply unit 110 above the swing bracket 150.

Further, the paper supply unit 110 has a gear plate 170 and a motor plate 180 coupled to one side surface thereof.

The gear plate 170 has a plurality of shaft holes 171 to 173 formed thereon to couple shafts sh1 to sh3 to which deceleration gears 130 are fitted thereto and a mounting hole 174 formed thereon to mount a platen gear pg onto a rotary shaft of the platen roller R2. According to the present invention, the deceleration gears 130 include a first deceleration gear 131 and a third deceleration gear 133 that are shaft-coupled to the first shaft sh1 fitted to the first shaft hole 171, a second deceleration gear 132 and a fourth deceleration gear 134 that are shaft-coupled to the second shaft sh2 fitted to the second shaft hole 172, and a fifth deceleration gear 135 that is shaft-coupled to the third shaft sh3 fitted to the third shaft hole 173.

The motor plate 180 has a motor hole 182 formed thereon to fit a pinion p onto a rotary shaft mh of a motor and an aligning hole 181 formed thereon to pass the shaft sh1 of the first deceleration gear 131 most closely adjacent to the motor therethrough.

According to the present invention, the deceleration gears 130 and the platen gear pg are mounted on the gear plate 180, so that the distances among the shafts of the deceleration gears 130 and the platen gear pg can be constantly maintained.

However, the pinion p is mounted onto the motor plate 180 separately provided from the gear plate 170, not onto the gear plate 170, so that it is very important to constantly maintain the distances among the shafts of the pinion p and the deceleration gears 130.

In detail, the pinion p and the first deceleration gear 131 have to be coupled to the motor and the first shaft sh1 in a state where the distance between the shafts of the pinion p and the first deceleration gear 131 is the same as a distance made by adding a radius of the pinion p to a radius of the first deceleration gear 131.

If the distance between the shafts of the pinion p and the first deceleration gear 131 is not accurately provided, the pinion p and the first deceleration gear 131 do not perfectly engage with each other, so that they may be broken or cause errors in power transfer operations. So as to achieve high quality images, accordingly, it is very important to accurately provide the distance between the shafts of the pinion p and the first deceleration gear 131.

To do this, the aligning hole 181 is formed on the motor plate 180, and the first shaft sh1 to which the first deceleration gear 131 is fitted passes through the aligning hole 181, thereby allowing the distance between the shafts of the pinion p and the first deceleration gear 131 to be accurately provided.

A distance between centers of the motor hole 182 and the aligning hole 181 to which the motor M and the pinion p are fitted, on the motor plate 180, is the same as the distance between the shafts of the pinion p and the first deceleration gear 131.

In detail, the distance between the motor hole 182 and the aligning hole 181 has to be accurately calculated so as to allow the distance between centers of the motor hole 182 and the aligning hole 181 to be equal to the distance made by adding the radius of the pinion p to the radius of the first deceleration gear 131.

Hereinafter, an explanation on the assembling order of the photo printer according to the first embodiment of the present invention will be given.

First, the first to third shafts sh1 to sh3 are fitted to the first to third shaft holes 171 to 173 of the gear plate 170, and next, the shaft pg of the platen roller R2 passes through the mounting hole 174 so that the platen roller R2 is mounted. Accordingly, the distances among the shafts of the first to fifth deceleration gears 131 to 135 and the distance between the shafts of the fifth deceleration gear 135 and the platen gear pg are accurately set, so that the first to fifth deceleration gears 131 to 135 can be precisely engage with one another, and also, the fifth deceleration gear 135 and the platen gear pg can precisely engage with one another.

After that, the motor M and the pinion p are mounted on the motor plate 180.

Next, the first shaft sh1 passes through the aligning hole 181 formed on the motor plate 180.

Sequentially, screws b1 and b2 are fastened to through holes 183 and 184 formed on the motor plate 180. Further, the gear plate 170 has a through hole 174 formed thereon to pass the screw b2 therethrough.

Lastly, the first to fifth deceleration gears 131 to 135 are mounted engagingly onto the shafts sh1 to sh3 fitted to the gear plate 170.

As a result, the distance between the shafts of the pinion p and the first deceleration gear 131, the distance between the shafts of the first deceleration gear 131 and the second deceleration gear 132, the distance between the shafts of the fourth deceleration gear 134 and the fifth deceleration gear 135, and the distance between the shafts of the fifth deceleration gear 135 and the platen gear pg can be accurately maintained, and accordingly, the gears can precisely engage with one another.

Figure 10:
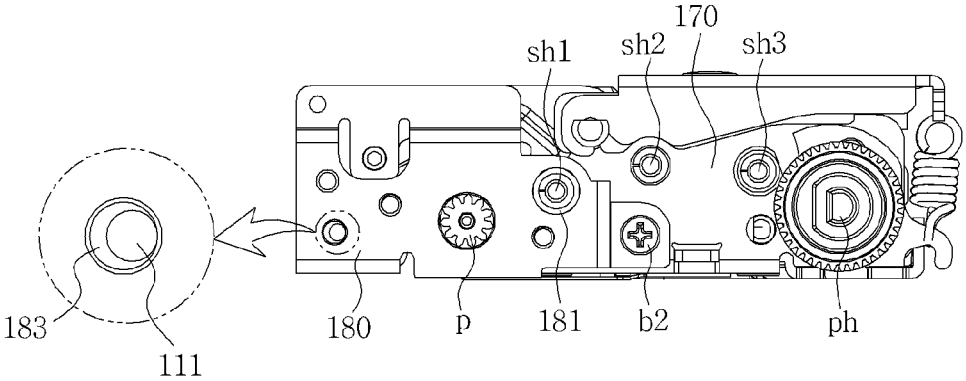
Figure 10:
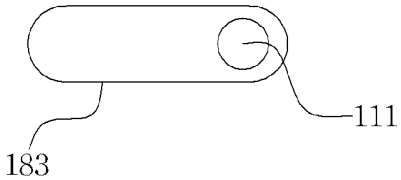

FIG. 10 shows a case where the gear plate 170 and the motor plate 180 are coupled to one side surface of the paper supply unit 110 in a state where the first shaft sh1 passes through the aligning hole 181.

The screw (See 'b1' of FIG. 9) for coupling the motor plate 180 and the paper supply unit 110 passes through the through hole 183 formed on the motor plate 180 and is then coupled to a coupling hole 111 formed on one side surface of the paper supply unit 110.

If the first shaft sh1 is alignedly passed through the aligning hole 181, at this time, the screw b1 is coupled to the coupling hole 111 in a state where the through hole 183 is eccentric to the coupling hole 111 according to the distance between the shaft of the pinion p and the first shaft sh1. So as to allow the through hole 183 to be eccentric to the coupling hole 111, in this case, the through hole 183 has to have a larger diameter than the coupling hole 111.

As shown in FIG. 10(*b*), otherwise, the through hole 183 does not have a shape of any circle but has a shape of a long hole. If the through hole 183 has a shape of the long hole, like this, an alignment range becomes more extended, thereby freely designing the position of the motor M.

According to the present invention, the motor M is mounted not on the gear plate 170 but on the motor plate 180, thereby advantageously permitting the photo printer to be designed to a small and slim size and to a variety of shapes.

MODE FOR INVENTION

Hereinafter, a photo printer according to a second embodiment of the present invention will be explained.

Figure 11:
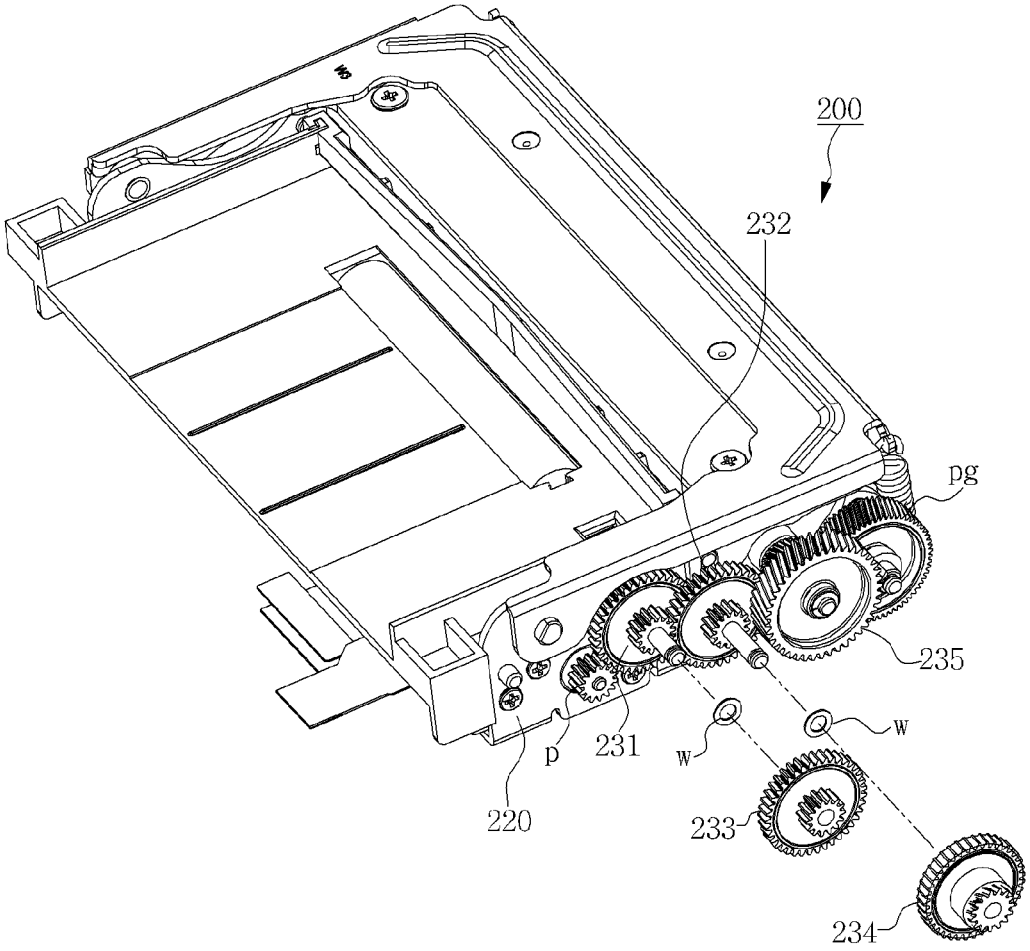
FIGS. 11 to 14 show a photo printer according to a second embodiment of the present invention.
Figure 12:
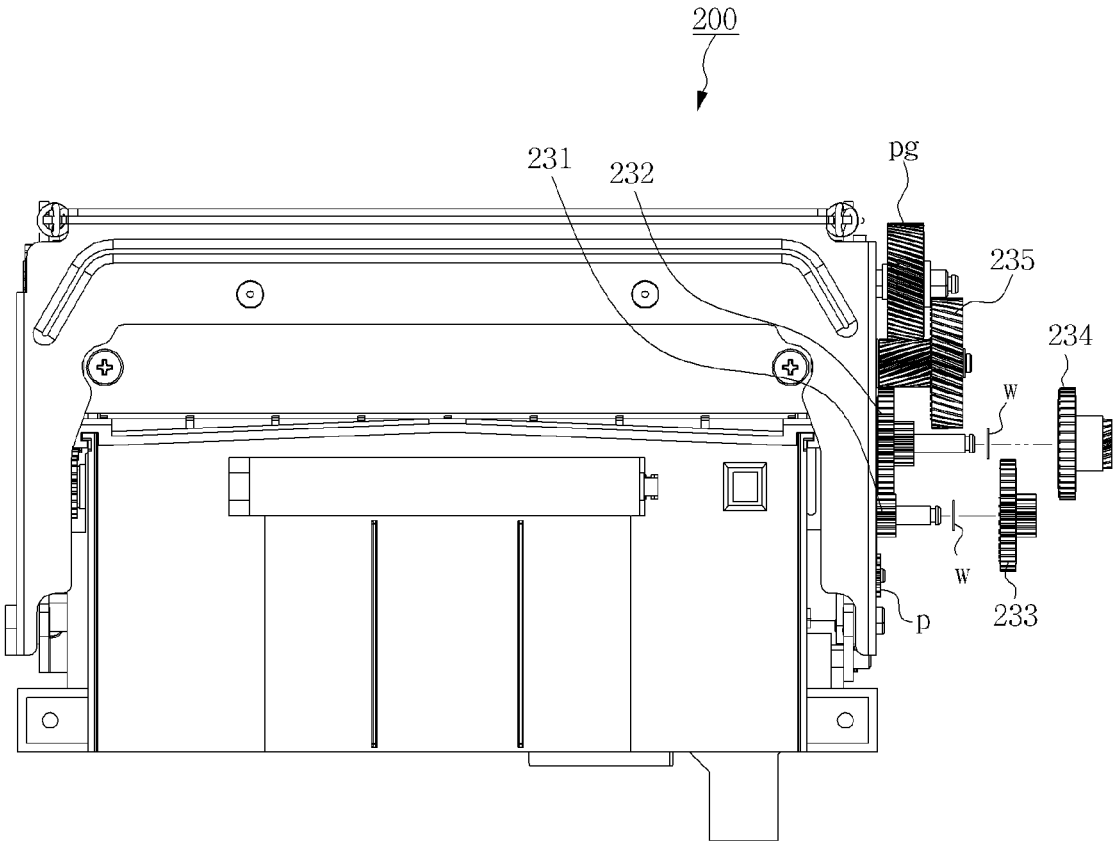

As shown in FIGS. 11 and 12, a photo printer 200 according to the second embodiment of the present invention includes a paper supply unit 210 for stackedly accommodating paper and having a pickup roller protruding from a bottom surface thereof, frames 220 coupled to both sides of the paper supply unit 210, a platen roller provided at a front end of the paper supply unit 210, a head provided above the platen roller, a swing bracket adapted to allow the head to be rotatably mounted onto the paper supply unit 210, and a pressurizing bracket rotatably mounted onto the paper supply unit 210 above the swing bracket. The above-mentioned configuration of the photo printer 200 is the same as those in the first embodiment of the present invention.

Further, a first deceleration gear 231 and a third deceleration gear 233 are adjacently fitted to one shaft and a second deceleration gear 232 and a fourth deceleration gear 234 are adjacently fitted to one shaft sh2, which are the same as in the first embodiment of the present invention.

According to the second embodiment of the present invention, however, a separation plate w is located between the first deceleration gear 231 and the third deceleration gear 233, and also, a separation plate w is located between the second deceleration gear 232 and the fourth deceleration gear 234.

The separation plates w are adapted to prevent the deceleration gears adjacently fitted to one shaft from being brought into close contact with each other, thereby allowing rotation of any one deceleration gear to give no influence on rotation of the other deceleration gear.

In detail, the rotary force of the first deceleration gear 231 is transferred only to the second deceleration gear 232 engaging therewith, but it is not transferred to the third deceleration gear 233.

In the same manner as above, the rotary force of the third deceleration gear 233 is transferred only to the fourth deceleration gear 234 engaging therewith, but it is not transferred to the first deceleration gear 231.

According to the second embodiment of the present invention, the separation plates w may be freely changed in shape. For example, they have a shape of a ring, but they may be fixed to the shafts, without any rotation.

Further, a bearing ball may be provided on one surface or both surfaces of the ring-shaped separation plate w so as to reduce a frictional force against the deceleration gears.

Figure 13:
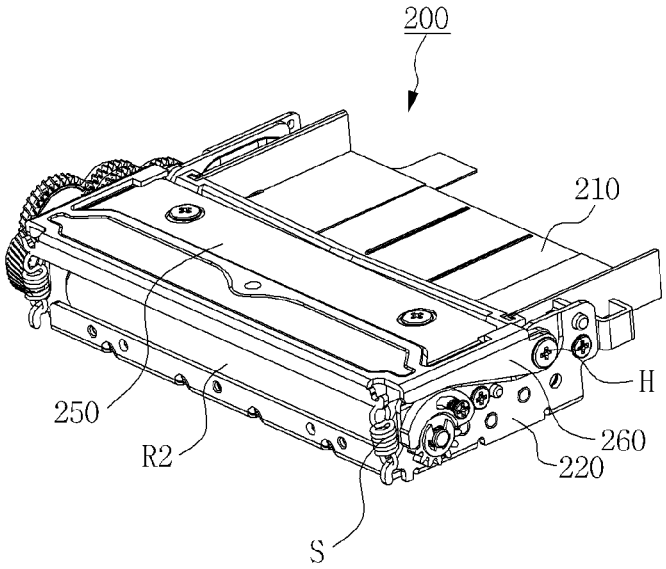
Figure 14:
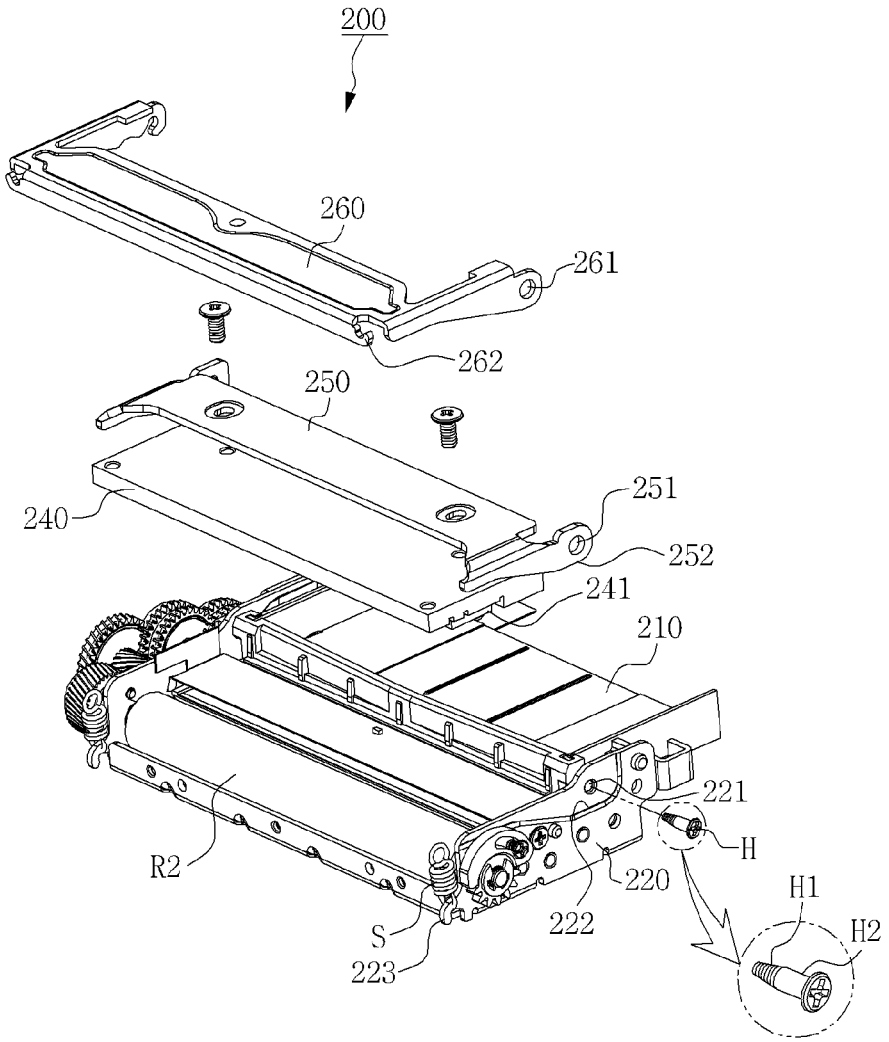

Referring to FIGS. 13 and 14, the photo printer 200 according to the second embodiment of the present invention has coupling holes formed on both sides of the paper supply unit 210.

Further, the frames 220 are coupled to both side walls of the paper supply unit 210, and the frames 220 have hinge holes 221 formed thereon.

The swing bracket 250 has hinge holes 251 formed on both ends thereof, and also, the pressurizing bracket 260 has hinge holes 261 formed on both ends thereof.

The swing bracket 250 and the pressurizing bracket 260 are mounted onto both sides of the paper supply unit 210. At this time, hinge pins H are screw-coupled to the coupling holes of the paper supply unit 210 in a state where the coupling holes of the paper supply unit 210, the hinge holes 221 of the frame 220, the hinge holes 251 of the swing bracket 250, and the hinge holes 261 of the pressurizing bracket 260 are located in a straight line. Of course, the hinge pins H sequentially pass through the hinge pins 251 of the pressurizing bracket 260, the hinge holes 251 of the swing bracket 250, and the hinge holes 221 of the frame 220.

Figure 6:
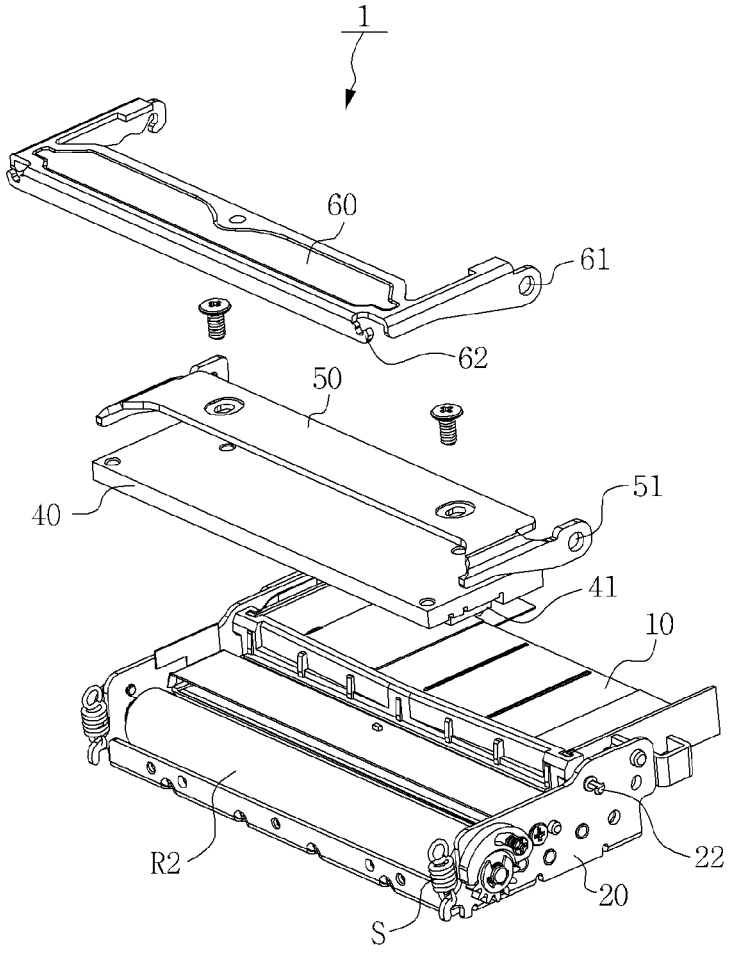
FIG. 6 Prior Art

According to the conventional photo printer as shown in FIG. 6, the hinge shafts 22 protrude integrally from both side walls of the paper supply unit 10 or the frame 20, but according to the present invention, the hinge pins H are screw-coupled to the coupling holes formed on the paper supply unit 210.

Under the above-mentioned configuration, the swing bracket 250 and the pressurizing bracket 260 can be hinge-coupled to the paper supply unit 210 even though both ends where the hinge holes 251 and 256 are formed are not open by means of an external force.

Each hinge pin H has a spiral portion H1 formed on an outer peripheral surface of one end thereof in such a manner as to be screw-coupled to the side wall, that is, the coupling hole of the paper supply unit 210 and a non-spiral portion H2 formed on top of the spiral portion H1 in such a manner as to become a center of the rotation of the swing bracket 250 and the pressurizing bracket 260.

Further, the frame 220 has seating grooves 222 steppedly formed thereon in such a manner as to seat both sides 252 of the swing bracket 250 where the hinge holes 251 are formed thereonto.

Figure 1:
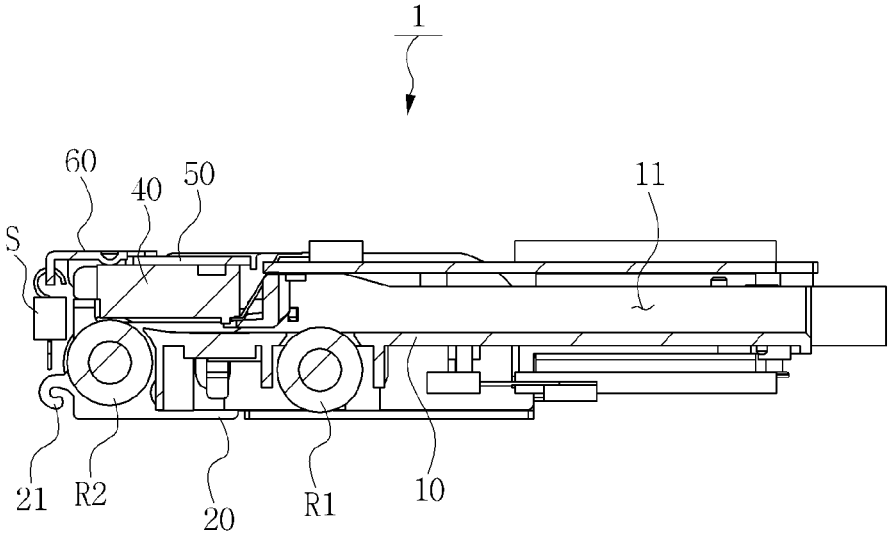
FIG. 1 Prior Art
FIGS. 1 to 6 show a conventional photo printer.
Figure 2:
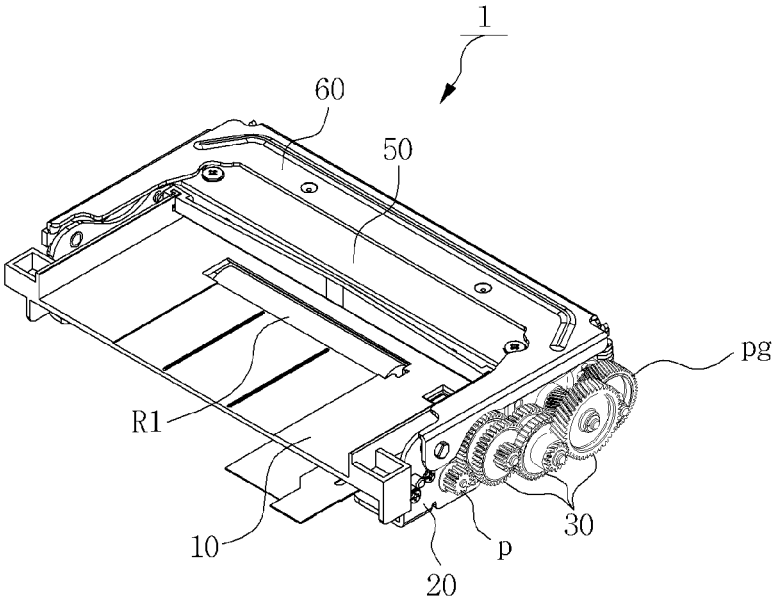
FIG. 2 Prior Art
Figure 3:
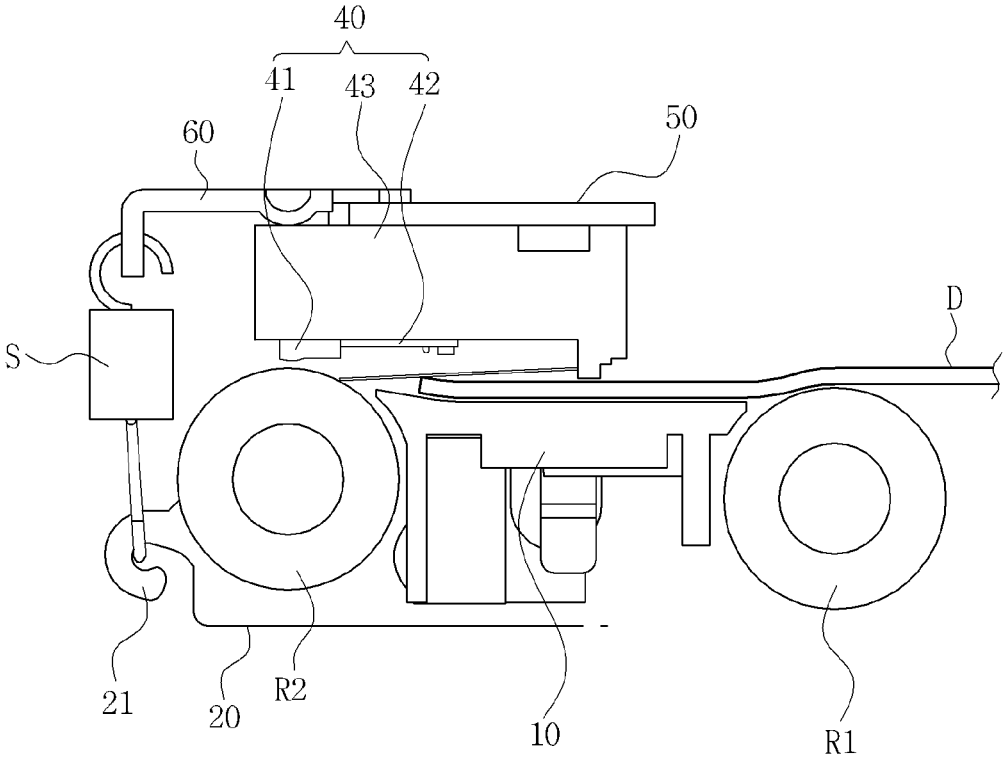
FIG. 3 Prior Art

The seating grooves 222 are adapted to form a given gap (See FIG. 3) between the head 240 and the platen roller R2. Through the operations of the springs S connected to locking portions 223 of the frame 220 and locking portions 262 of the pressurizing bracket 260, in detail, the swing bracket 250 to which the head 40 is coupled is pulled downward, but the head 240 does not come into contact with the platen roller R2 by means of the seating grooves 222, so that the given gap between the head 240 and the platen roller R2 can be formed.

Figure 15:
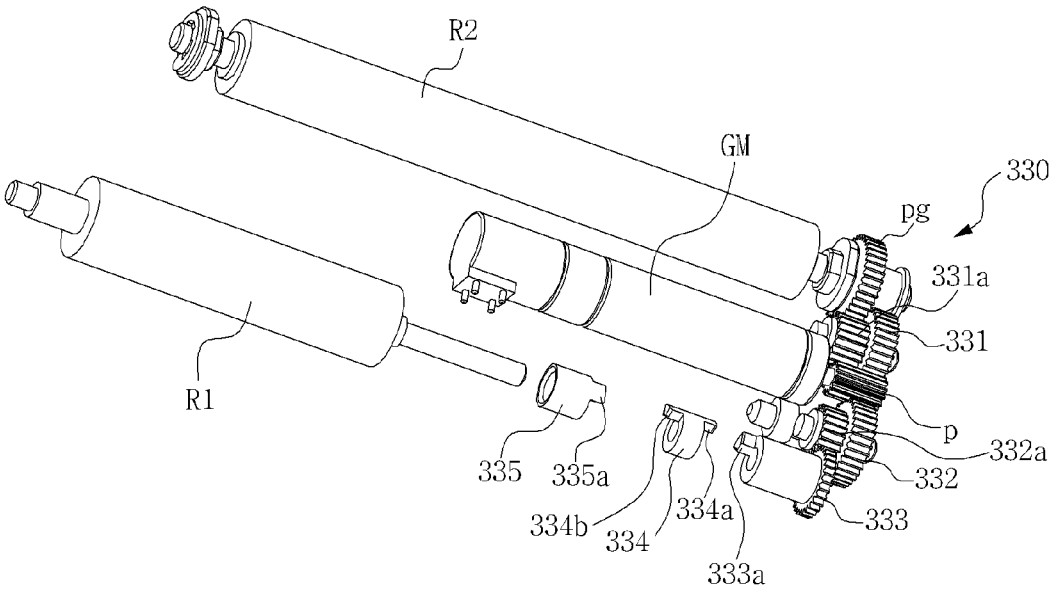
FIGS. 15 and 16 show main parts of a photo printer according to a third embodiment of the present invention.
Figure 16:
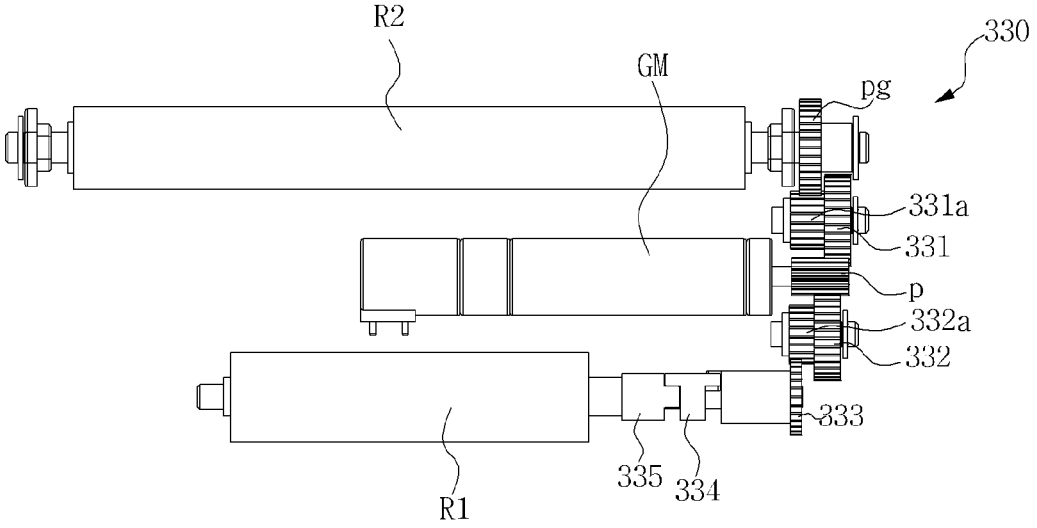

FIGS. 15 and 16 show a photo printer, especially a driving assembly for rotating a platen roller R2 and a pickup roller R1, according to a third embodiment of the present invention.

As shown, the driving assembly according to the third embodiment of the present invention includes a geared motor GM having deceleration gears built therein. The geared motor GM is a well known device that is configured to have a cylindrical pipe combined with a motor and deceleration gears as an integral body, and for the brevity of the description, therefore, a detailed explanation on the geared motor GM will be avoided below. Accordingly, a rotary force of the motor is reduced through the deceleration gears and is then transferred. Further, a pinion p to which the reduced rotary force is transferred is provided.

Moreover, a platen gear pg is fitted onto a rotary shaft of the platen roller R2, and a first transfer gear is located between the pinion p and the platen gear pg. The first transfer gear is a double gear that is configured to have a driven gear 331 engaging with the pinion p and a drive gear 331*a* engaging with the platen gear pg.

Also, a pickup gear 333 is fitted onto a rotary shaft of the pickup roller R1, and a second transfer gear is located between the pinion p and the pickup gear 333. The second transfer gear is a double gear that is configured to have a driven gear 332 engaging with the pinion p and a drive gear 332*a* engaging with the pickup gear 333.

Accordingly, the geared motor GM transfers the reduced rotary force to the pinion p and the driven gear 331 of the first transfer gear, sequentially, and the rotary force is then reduced through the drive gear 331*a*. Next, the reduced rotary force is transferred to the platen gear pg and thus rotates the platen roller R2.

Simultaneously, the driving force of the geared motor GM is transferred to the pinion p and the driven gear 332 of the second transfer gear, sequentially, and the rotary force is then reduced through the drive gear 332*a*. Next, the reduced rotary force is transferred to the pickup gear 333 and thus rotates the pickup roller R1.

Figure 4:
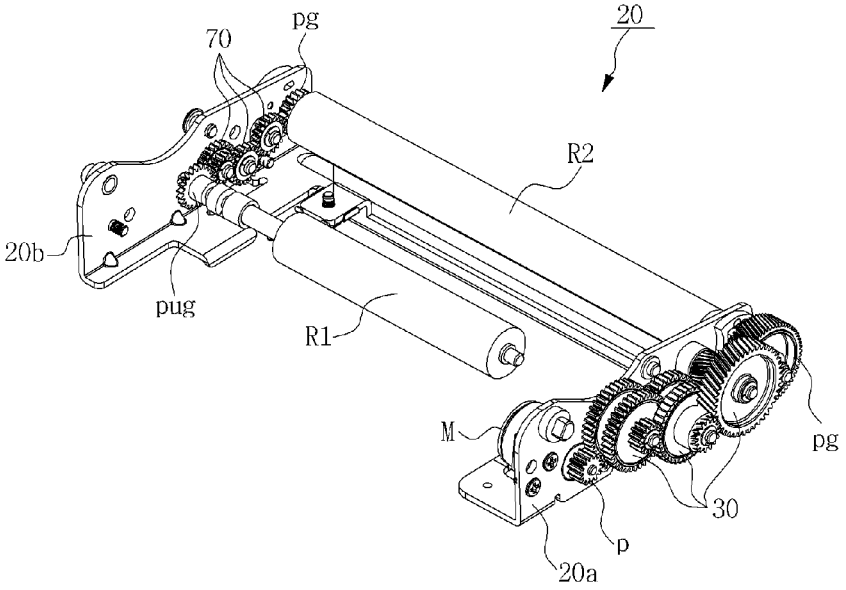
FIG. 4 Prior Art
Figure 4:
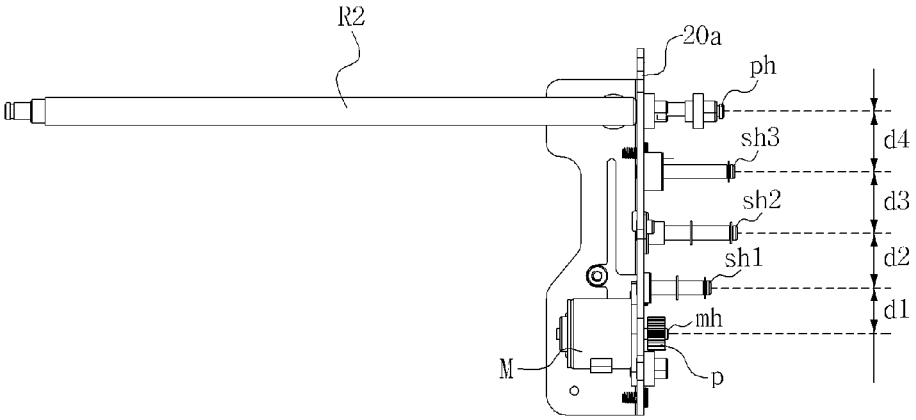
FIG. 4 Prior Art
Figure 5:
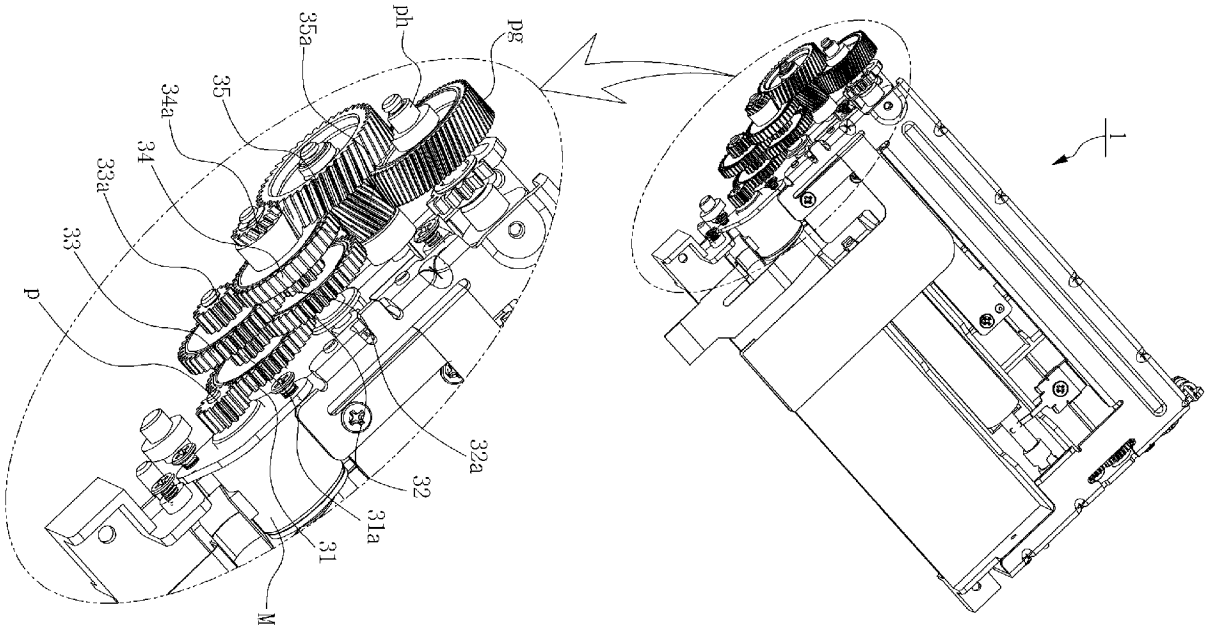
FIG. 5 Prior Art

In the conventional technology as shown in FIG. 4, on the other hand, the platen roller R2 is rotated by means of the driving force of the motor, and the rotary force of the platen roller R2 is transferred to the pickup roller R1. According to the present invention, however, the driving force of the geared motor GM is transferred to the pinion p and is then simultaneously transferred directly to both of the platen roller R2 and the pickup roller R1, thereby rotating the platen roller R2 and the pickup roller R1.

According to the present invention, the gears are provided only on one side surface of the paper supply unit 210.

In the conventional technology as shown in FIG. 4, however, the gears 30, which transfer the driving force of the motor M to the platen roller R2, are provided on one side surface of the paper supply unit 10, and the gears 70, which transfer the rotary force of the platen roller R2 to the pickup roller R1, are provided on the other side surface of the paper supply unit 10.

If the gears 30 for driving the platen roller R2 and the gears 70 for driving the pickup roller R1 are provided on the different side surfaces from each other, not on the same side surface as each other, as explained in the conventional technology, a load is applied to the rotary shaft ph of the platen roller R2 itself, thereby causing the platen roller R2 to be inclined toward any one side. Accordingly, the platen roller R2 fails to straightly move the paper in a forward direction, so that undesirably, the paper is inclinedly moved forward.

According to the present invention, however, the pickup roller R1 does not receive the rotary force of the platen roller R2 but directly receives the rotary force of the geared motor GM, and thus, the pickup roller R1 is rotated. As a result, the platen roller R2 can straightly move the paper forward, without any inclination.

Furthermore, the gears are provided on the same side surface of the paper supply unit 210, thereby making their configuration simplified. Through the use of the geared motor GM, especially, the number of gears can be drastically decreased.

According to the present invention, also, gear ratios between the platen gear pg and the pickup gear 333 and between the first transfer gear and the second transfer gear are controlled so that a rotating speed of the platen roller R2 is faster than that of the pickup roller R1.

According to the present invention, further, the photo printer further includes the first transfer gear and the second transfer gear, but they may be not needed necessarily.

According to the present invention, on the other hand, the photo printer further includes clutch means adapted to supply long paper.

Referring to FIGS. 15 and 16, the pickup gear 333 engaging with the drive gear 332*a* of the second transfer gear has a protrusion 333*a* protruding from one side thereof.

The protrusion 333*a* is rotated and locked onto a first locking projection 334*a* formed on one side of an idle clutch

334, thereby rotating the idle clutch 334, and next, a second locking projection 334*b* formed on the other side of the idle clutch 334 is locked onto a third locking projection 335*a* of a clutch 335 coupled to the pickup roller R1, thereby rotating the pickup roller R1.

Like this, the pickup gear 333 rotates the pickup roller R1 through the idle clutch 334 and the clutch 335, while being not fitted to the rotary shaft of the pickup roller R1, so that a time difference in the rotation of the pickup gear 333 and the pickup roller R1 exists. Through the existence of the time difference, accordingly, time is obtained when the platen roller R2 moves the paper forward, thereby making use of relatively long paper.

INDUSTRIAL APPLICABILITY

According to the present invention, the photo printer is capable of accurately moving the paper, thereby obtaining high quality images.

According to the present invention, further, the photo printer is capable of being reduced in size, slimmed in design, and decreased in manufacturing cost through the reduction in the number of parts.

The invention claimed is:

1. A photo printer comprising:

a paper supply unit for stackedly accommodating paper and having a pickup roller protruding from a bottom surface thereof;

a platen roller provided at a front end of the paper supply unit;

a head provided above the platen roller to form an image on the paper fed;

a motor for providing a driving force to the platen roller;

deceleration gears for reducing revolutions per minute of the motor;

a gear plate provided on one side surface of the paper supply unit in such a manner as to allow the deceleration gears to be shaft-coupled thereto; and a motor plate having an aligning hole adapted to allow one of the deceleration gears to pass therethrough and a motor hole adapted to allow a rotary shaft of the motor to pass therethrough.

2. The photo printer according to claim 1, wherein so as to allow the motor plate to be coupled to one side surface of the paper supply unit, the motor plate has a through hole formed thereon and the paper supply unit has a coupling hole formed thereon, the through hole being larger than the coupling hole.

3. The photo printer according to claim 1, wherein the deceleration gears are shaft-coupled to the gear plate, and a shaft of a deceleration gear most closely adjacent to the motor passes through the aligning hole.

4. The photo printer according to claim 1, wherein two or more of the deceleration gears are adjacently fitted to one shaft mounted on the gear plate, and a separation plate is provided between the two or more of the deceleration gears adjacently fitted to the one shaft.

5. The photo printer according to claim 1, further comprising:

a swing bracket having one end on which the head is mounted and the other end having hinge holes coupled to both sides of the paper supply unit; and hinge pins coupled to a side wall of the paper supply unit in such a manner as to pass through the hinge holes of the swing bracket.

6. The photo printer according to claim 5, wherein each of the hinge pins comprises:

a spiral portion formed on an outer peripheral surface thereof in such a manner as to be screw-coupled to the side wall of the paper supply unit; and a non-spiral portion protruding from the side wall of the paper supply unit in such a manner as to become a center of rotation of the swing bracket.

* * * * *